US010463207B2

(12) United States Patent
Bates et al.

(10) Patent No.: US 10,463,207 B2
(45) Date of Patent: Nov. 5, 2019

(54) ONE USE PORTABLE TOILET PAPER DISPENSE SYSTEM

(71) Applicants: Linda Jane Bates, Houston, TX (US); Rodger Clifford Bates, II, Houston, TX (US)

(72) Inventors: Linda Jane Bates, Houston, TX (US); Rodger Clifford Bates, II, Houston, TX (US)

( * ) Notice: Subject to any disclaimer, the term of this patent is extended or adjusted under 35 U.S.C. 154(b) by 0 days.

(21) Appl. No.: 15/530,583

(22) Filed: Feb. 3, 2017

(65) Prior Publication Data

US 2018/0078100 A1 Mar. 22, 2018

Related U.S. Application Data

(60) Provisional application No. 62/339,119, filed on May 20, 2016.

(51) Int. Cl.

| | |
|---|---|
| ***A47K 10/00*** | (2006.01) |
| ***A47K 10/42*** | (2006.01) |
| ***B65D 75/00*** | (2006.01) |

(52) U.S. Cl.

CPC ..... *A47K 10/42* (2013.01); *B65D 75/00* (2013.01)

(58) Field of Classification Search

CPC .. A47K 10/42; A47K 2010/428; A47K 10/16; A47K 10/18; A47K 10/185; A47K 10/20

USPC ..... 206/494, 210

See application file for complete search history.

(56) References Cited

U.S. PATENT DOCUMENTS

| | | | | |
|---|---|---|---|---|
| 1,522,220 | A * | 1/1925 | Wood | A47K 10/42 150/131 |
| 3,429,718 | A * | 2/1969 | Helms | B65D 31/12 206/541 |
| 6,213,346 | B1 * | 4/2001 | Skerrett | A47K 10/42 221/48 |
| 6,533,119 | B1 * | 3/2003 | Hansen | A47K 7/00 206/494 |
| 6,550,635 | B1 * | 4/2003 | King | A45F 5/02 221/185 |
| 7,644,836 | B2 * | 1/2010 | Morin | B65D 83/0835 206/494 |
| 8,256,616 | B2 * | 9/2012 | Eilert | B65D 75/5827 206/391 |
| 8,496,108 | B2 * | 7/2013 | Bahcall | A47K 10/42 206/210 |
| 8,689,528 | B1 * | 4/2014 | Gaspari | B65D 83/0894 206/494 |
| 2002/0039638 | A1 * | 4/2002 | Bando | A47K 10/42 428/126 |
| 2002/0155234 | A1 * | 10/2002 | Seth | A47K 7/00 428/35.2 |
| 2006/0231427 | A1 * | 10/2006 | Graneto, III | B65D 75/20 206/210 |
| 2007/0251851 | A1 * | 11/2007 | Warren | A61F 13/84 206/494 |

(Continued)

OTHER PUBLICATIONS

Zero Trees Toilet Paper Pocket Pack May 6, 2014); Amazon; (https://www.amazon.com/Zero-Trees-Toilet-Paper-Pocket/dp/B00K5PUWB2).*

*Primary Examiner* — Ernesto A Grano
(74) *Attorney, Agent, or Firm* — Karen B. Tripp

(57) ABSTRACT

The one use toilet paper dispense system is to encapsulate folded toilet paper squares within a 3 inch by 3 inch individual sealed package with a tear line indicated on one corner.

5 Claims, 1 Drawing Sheet

(56) References Cited

U.S. PATENT DOCUMENTS

2008/0053861 A1* 3/2008 Mellin ..... B65D 75/5838
206/494
2011/0042257 A1* 2/2011 Mueller ..... B65D 77/24
206/494
2014/0034541 A1* 2/2014 Ho-Kleinwaechter .....
B65D 75/5833
206/494
2014/0034542 A1* 2/2014 Cuellar ..... B65D 75/5833
206/494

* cited by examiner

ONE USE PORTABLE TOILET PAPER DISPENSE SYSTEM

CROSS-REFERENCE TO RELATED APPLICATIONS

This application claims priority from U.S. Provisional Patent Application No. 62/339,119, filed May 20, 2016.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the field of products to aid personal hygiene and more particularly to toilet paper and toilet paper dispensers.

2. Description of Related Art Including Information Disclosed Under 37 CFR 1.97 and 1.98

Whenever an individual whether male or female enters a bathroom in a public restroom or into portable toilet at an event or in a camping situation, there is always a need for one use portable toilet paper dispense system instead of trusting that there is a roll of toilet paper in the stall. This one use dispensing system solves that issue thereby having at hand an individual package of premeasured toilet paper to handle personal hygiene. It is portable and biodegradable is one solution with 10 sheets to amply solve personal hygiene whenever and wherever needed.

BRIEF SUMMARY OF THE INVENTION

Primary Points of Advantage Follow:

Point 1) to always have a personal portable toilet paper solution at hand for emergencies.

Point 2) To have a total biodegradable solution so that it leaves a biofriendly foot print whether flushed or not.

Point 3) This package solves personal hygiene whenever needed discreetly and solves a biofriendly problem.

Point 4) It solves an ever pressing problem of needing toilet paper whenever an unfortunate situation comes up in a public restroom or at a well attended public event so that any individual can be prepared. It has happened to each of us at one time or another.

DETAILED DESCRIPTION OF THE INVENTION

This application is for a one use toilet paper dispensing system, and it is disposable in its entirety as well as biodegradable. That is, in one embodiment, both the toilet paper and the package may be comprised of biodegradable material, such as for example biodegradable paper. In an alternative embodiment, the toilet paper may be comprised of biodegradable paper and the package may be comprised of a waterproof material such as for example standard poly bag material. In a preferred embodiment, the waterproof material is biodegradable.

Figure 1:
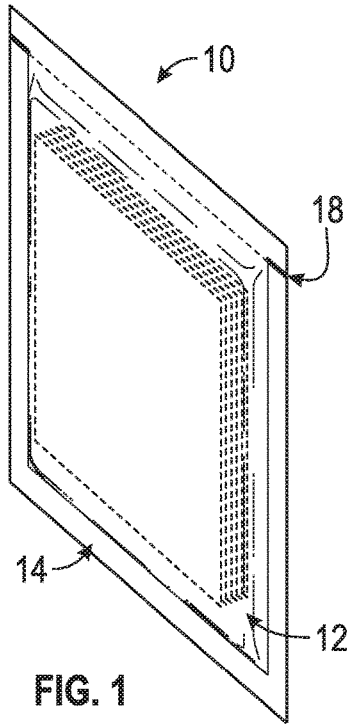
FIG. 1 is a side perspective view of the toilet paper dispensing system of the present invention, containing an individual sized and one-time-use amount of toilet paper within the package or dispenser of the system.
Figure 2:
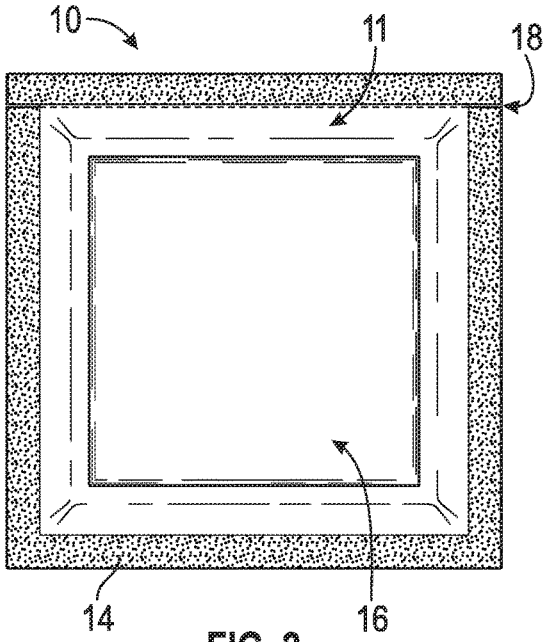
FIG. 2 is a front view of the dispensing system of FIG. 1, with one side of the package cut-away to show the interior of the package and the package seal area.
Figure 3:
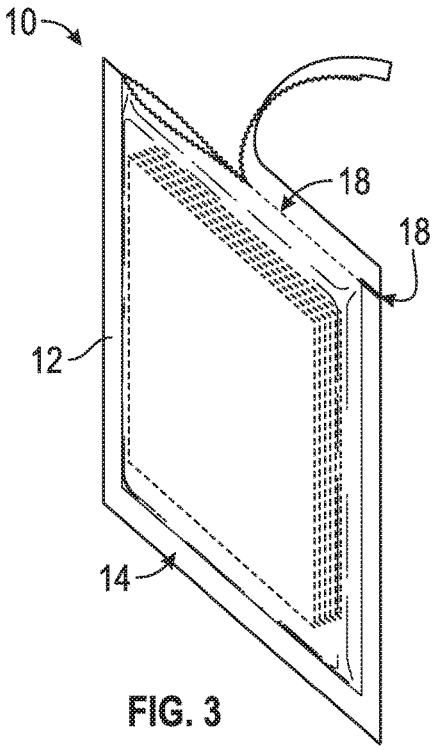
FIG. 3 is another side perspective view of the dispensing system of FIG. 1, demonstrating tearing across the package tear line for opening to avoid tearing in the middle of the package.
Figure 4:
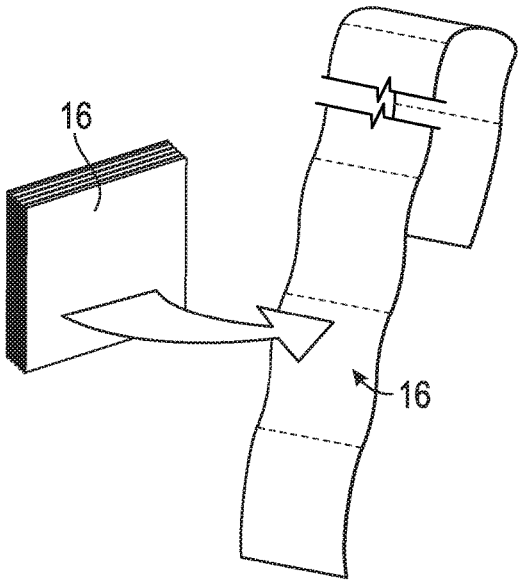
FIG. 4 is a view of the toilet paper used in the dispensing system of the invention, shown folded as it would be held in the package, and opened out as it would be available for use outside the package.

In a preferred embodiment, ten sheets of toilet paper are used in an individual package. That is, in one embodiment, the system of the invention comprises ten sheets of toilet paper folded to fit an individual-sized package. Such fold may be accomplished for example by folding the ten sheets of toilet paper five times. Although reference is made to "ten sheets," the toilet paper may be one continuous sheet with perforations, as shown in FIG. 4, that would make it divisible into sheets, such as ten sheets in number.

In one embodiment and referring to the Figures, an individual-sized package 10 comprises two sides 11 and 12, each about 3 inches square, sealed at the edges 14 to comprise a 3"×3" package, and the toilet paper 16 is folded to be about 2 inches square, allowing for the package seal to be about ¼ inch wide and the gap between the seal and the toilet paper to be about ½ to ¾ inch. A tear line 18 positioned near the top of the package, within or at the interior border of the seal, allows for opening of the package 10 for access to the toilet paper 16 for use, without tearing the toilet paper in the opening.

In researching "toilet paper dispensing" Patent numbers all searched under PATFT Numbers 1-65 and APPFT Numbers 1-45 none described a portable dispense unit solution. There was not a travel toilet paper solution identified that meets these needs per research under various search terms. This is a unique and underserved area of patents.

The invention claimed is:

1. A one-time use, disposable flushable and biodegradable toilet paper dispensing system consisting of a two-sided, 3 inch square shaped, disposable, flushable and biodegradable package, having four edges and four corners that are sealed on all four edges and corners, creating a sealed perimeter portion and having contained therein a one-time use, 10-sheet quantity of disposable, flushable and biodegradable toilet paper folded to be 2 inches square, and positioned inside the package such that, when centered, there is a gap in the range of ½ to ¾ inches between said sealed perimeter portion and the toilet paper, and wherein the package has a tear open mark adjacent to at least one of said four corners and a tear line or a tear line, for tearing open the package and accessing the toilet paper near at least one edge of the package, so as to avoid tearing the toilet paper inside the package when tearing open the package.

2. The system of claim 1 wherein the package is comprised of paper.

3. The system of claim 2 wherein the package material can receive a waterproof application.

4. The system of claim 1 wherein the toilet paper has perforations for assisting in tearing each of the ten sheets of the toilet paper.

5. The system of claim 1 wherein the package has a tear open mark adjacent to at least two of said four corners for tearing open the package.

* * * * *